US006758581B2

(12) United States Patent
Weinhuber

(10) Patent No.: US 6,758,581 B2
(45) Date of Patent: Jul. 6, 2004

(54) WINDING APPARATUS WITH GUIDING MEANS

(75) Inventor: Konrad Weinhuber, Oberländerstr. 27, D-81371 Munich (DE)

(73) Assignee: Konrad Weinhuber, Munich (DE)

( * ) Notice: Subject to any disclaimer, the term of this patent is extended or adjusted under 35 U.S.C. 154(b) by 0 days.

(21) Appl. No.: 10/300,159

(22) Filed: Nov. 20, 2002

(65) Prior Publication Data

US 2003/0095412 A1 May 22, 2003

(30) Foreign Application Priority Data

Nov. 20, 2001 (DE) ..... 201 18 773 U

(51) Int. Cl.[7] ..... F21V 17/08

(52) U.S. Cl. ..... 362/285; 362/258; 362/387; 362/286; 362/403; 362/288

(58) Field of Search ..... 362/285, 258, 362/387, 286, 288, 386, 403; 242/377, 378.3, 399.1, 541.6

(56) References Cited

U.S. PATENT DOCUMENTS 5,420,772 A * 5/1995 Evans ..... 362/386
2001/0040200 A1 * 11/2001 Kaipf et al. ..... 242/541.8

FOREIGN PATENT DOCUMENTS

| | | |
|---|---|---|
| DE | 175565 | * 10/1906 |
| DE | 1765470 | * 4/1958 |
| DE | 3120938 | * 2/1982 |
| DE | 4413381 | * 10/1994 |
| DE | 29518031 | * 4/1996 |

* cited by examiner

*Primary Examiner*—Alan Cariaso
*Assistant Examiner*—Mark Tsidulko
(74) *Attorney, Agent, or Firm*—Howard & Howard

(57) ABSTRACT

A winding apparatus (23) having a guiding means (25) by means of which a drawing material (32) can be led onto a cylindrical drum surface (37) of a reel (24) rotatable about its axis (26) relative to the guiding means (25) and said drawing material can be taken up onto said drum surface (37), is used for instance for adjusting the height of a suspended luminaire. In order to optically advantageously configure the connection of this winding apparatus (23) to the drawing material (32), the axis (26) of the reel (24) is oriented in the direction in which the drawing material (32) runs on entering the winding apparatus (23).

14 Claims, 3 Drawing Sheets

WINDING APPARATUS WITH GUIDING MEANS

FIELD OF THE INVENTION

The invention relates to a winding apparatus with a guiding means, by means of which a drawing means can be guidedly taken up on a cylindrical drum surface of a reel rotating about an axis relative to the guiding means.

BACKGROUND OF THE INVENTION

Such a winding apparatus is generally known for taking up a carrier cable of a mains-power operated suspended luminaire, wherein the carrier cable is guided within the spirally wound mains cable for supplying the suspended luminaire with electrical power.

Such winding apparatuses are generally, for appearance reasons, concealed in the ceiling fixture of the suspended luminaire, under a suspended ceiling, for example. In the conventional suspended luminaire equipped with ceiling fastener hooks for mounting, the winding apparatus is usually integrated in a covering concealing said hooks and the power feed, whereby said covering is necessarily naturally larger than in comparable lighting fixtures not having level adjusting means.

The known winding apparatus comprises essentially a horizontally disposed reel for taking up the carrier cable into a plastic housing that is closed, save for an entry aperture disposed in the bottom part thereof for admitting the carrier cable. The carrier rope is wound or unwound in said housing by rotating the reel about its axis, whereby a torsion spring disposed on the housing and the reel substantially maintains the balance of the weight force of the luminaire member. In this fashion the luminaire member can be adjusted to a desired height without great expenditure of force within the predefined range of the length of the carrier rope.

The known winding apparatuses are hardly appropriate for implementation in the field of low-voltage lighting technology because of their considerable intrinsic dimensions.

SUMMARY OF THE INVENTION AND ADVANTAGES

The object of the present invention is to provide a winding apparatus which, by virtue of its dimensions, is suitable as a height adjustment of a low-voltage suspended luminaire and can be connected with same in an optically advantageous fashion.

On the basis of the winding apparatus described at the beginning, said object is achieved in that the axis of the reel is oriented in the direction in which the drawing material runs upon entry into the winding apparatus. In this fashion, the winding apparatus can be configured particularly narrowly and especially optically appropriately in the case of a suspended luminaire.

In a preferred embodiment of the invention the reel is formed as to be displaceable in the direction of its axis relative to the guiding direction. The windings of the drawing material can be taken up axially offset on the reel.

A necessary coupling of the rotation and translatory movement of the reel relative to the guiding direction can be realized without additional mechanical components by interlocking threads in a contact surface of the two components. If the chosen pitch of the thread is (at least slightly) greater than the diameter of the drawing material then the successive coils of the drawing material are taken up in a particularly simple fashion alongside each other on the reel.

The number of components of the winding apparatus according to the invention can be kept to a minimum if the thread on the drum surface of the reel and on an inner cylinder surface are applied to a guiding means encircling the reel. If in this instance (as described above) the lead—or pitch—of the thread is greater than the diameter of the drawing material, then the latter is specifically taken up in the thread troughs. If two separate drawing materials are taken up on the same reel at the same time—for example in the case of a low-voltage halogen luminaire suspended on two lines—said thread is particularly advantageously executed having a double thread.

In an alternative embodiment the guiding means comprises a spike with a thread on the external side, said spike engaging with an inner thread of the reel. The drawing material is then preferably taken up on a non-profiled drum surface. In order to keep manufacturing costs low, the spike can be manufactured out of a thermoplastic synthetic material using an injection molding process and integrated with the formed thread in one single work step. High-quality material that is more costly to work—metal (aluminum for example) or colored glass—can be used for those components of the guiding means that comprise visible surfaces.

Preferably, the winding apparatus—especially when used for adjusting the height of a suspended luminaire—can be equipped with a driver device which eliminates manual intervention in the winding apparatus for winding or unwinding the drawing material. As in the case of the winding apparatuses known from the prior art, a torsion spring can be used as the driver device, which maintains the balance of a drawing force in the drawing material. The winding and unwinding of the drawing material is then set into motion by a slight change in the tractive force—by slight lifting of the body of the lamp body of the suspended luminaire, for example.

A further embodiment comprises—alternatively or in addition to the torsion spring—a motor which is, for example, controlled by a logical circuit integrated in the winding apparatus and an optical sensor enables contact-less winding and unwinding of the drawing material—for example for adjusting the height of a suspended luminaire.

In a preferred embodiment of the winding apparatus according to the invention, the drawing material is first led through the reel and only then through the guiding means on the drum surface of the reel. In particular in the case of use as a height adjustment for a suspended luminaire there is the advantage that only the upper end of the winding apparatus—in this case, the reel—rotates relative to the drawing material. This rotational movement is thus not transferred to the lamp body below the winding apparatus—in this case, the guiding means.

The winding apparatus according to the invention can be used particularly for adjusting the height of a suspended luminaire. Because of the fact that the longitudinal axis of the reel lies in the direction of the drawing material the winding apparatus is particularly optically advantageous when integrated into the typical filigree construction of a low-voltage luminaire.

The impression of the simplicity of the construction is especially supported, when the drawing material carrying the luminaire is an electrical cable providing the electrical supply to the luminaire, especially when both lines are integrated in it—in this instance the use of a coaxial cable is preferred. If a coaxial cable is used that is not insulated to the outside, then the luminaire can be particularly easily combined with a contact dimmer as has been disclosed in DE 196 28 891.

A variety of possible designs for such a suspended luminaire using the winding apparatus according to the invention result especially if it is incorporated with the luminaire member in one structural unit.

BRIEF DESCRIPTION OF THE DRAWINGS

The invention is more completely described below with reference to three exemplary embodiments, which are schematically represented in three drawings, wherein.

DETAILED DESCRIPTION OF THE PREFERRED EMBODIMENT

Figure 1:
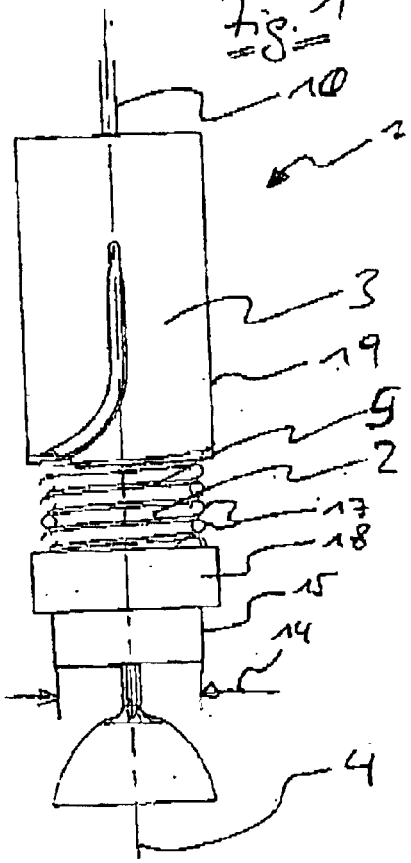
FIG. 1 represents a side view of a winding apparatus.
Figure 2:
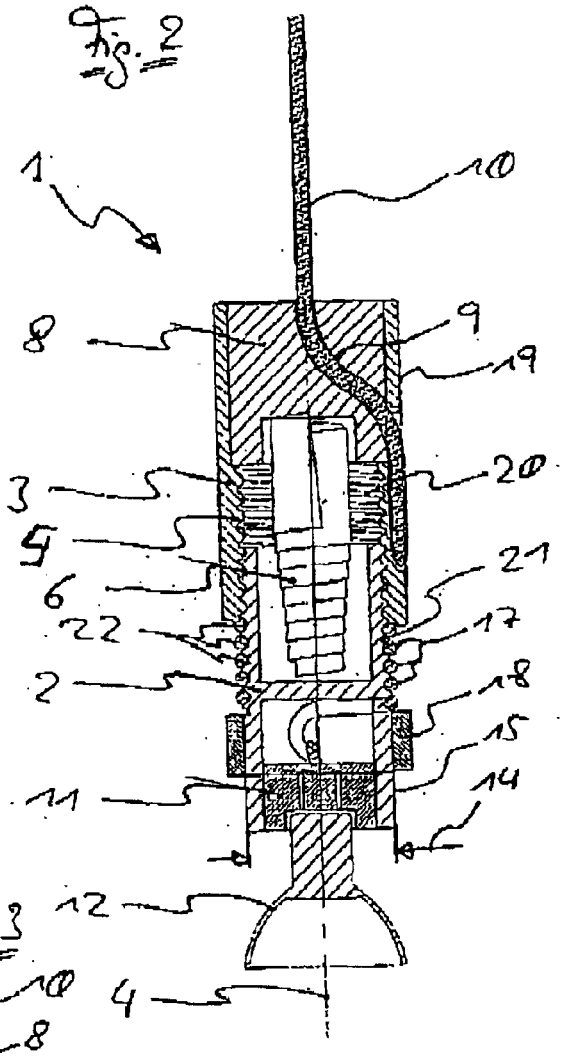
FIG. 2 represents a longitudinal section.
Figure 3:
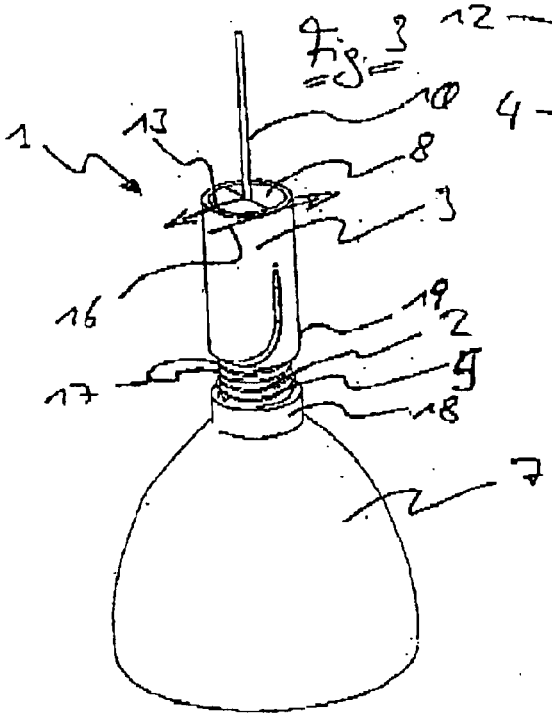
FIG. 3 represents a perspective view of the winding apparatus represented in FIG. 1.
Figure 4:
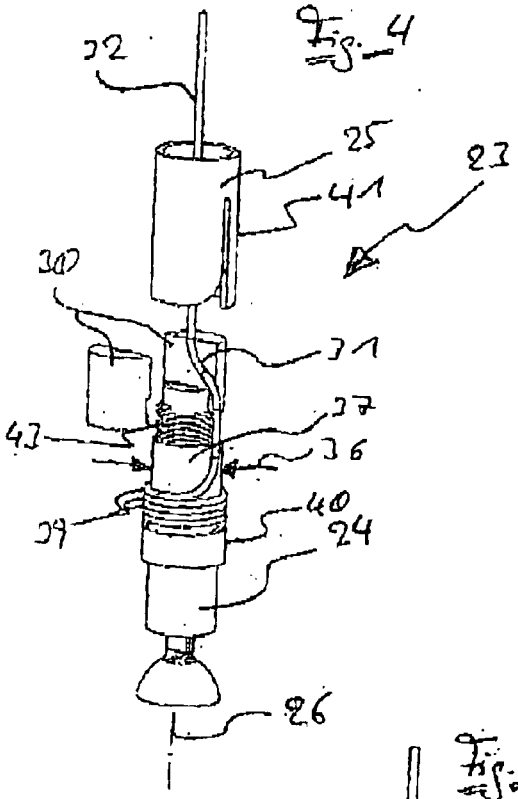
FIG. 4 represents a perspective exploded view of a second winding apparatus.
Figure 5:
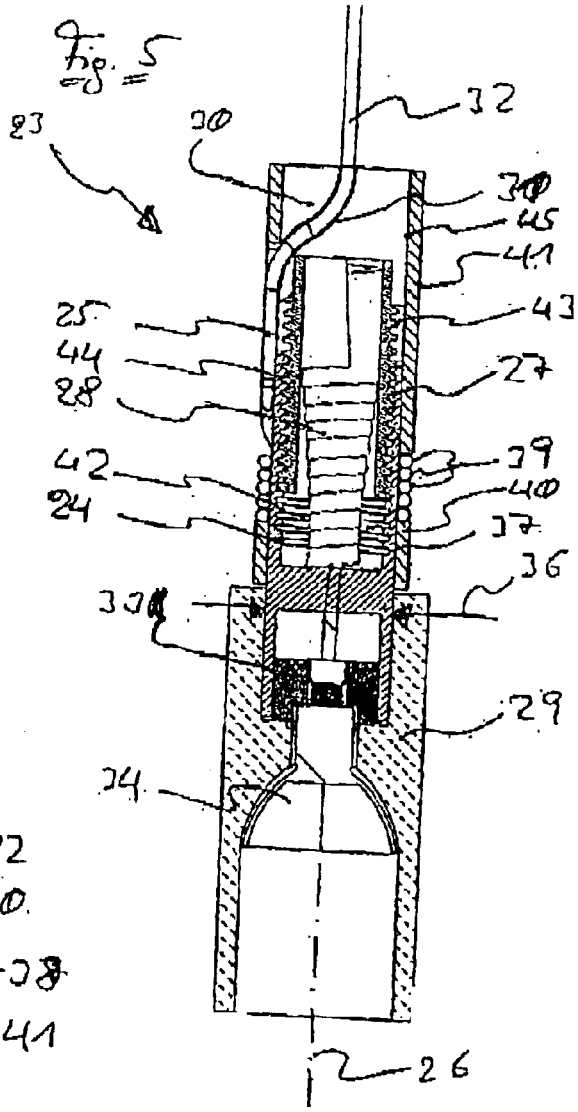
FIG. 5 represents a longitudinal section.
Figure 6:
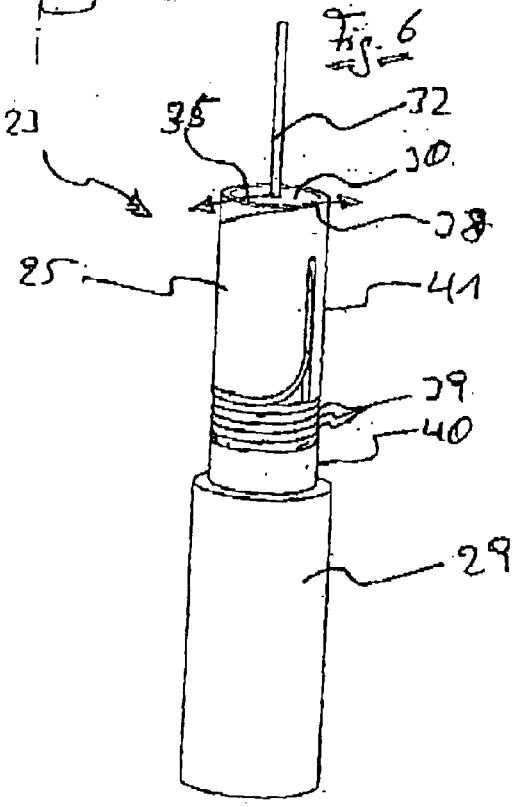
FIG. 6 represents a perspective view of the winding apparatus according to FIG. 2.
Figure 7:
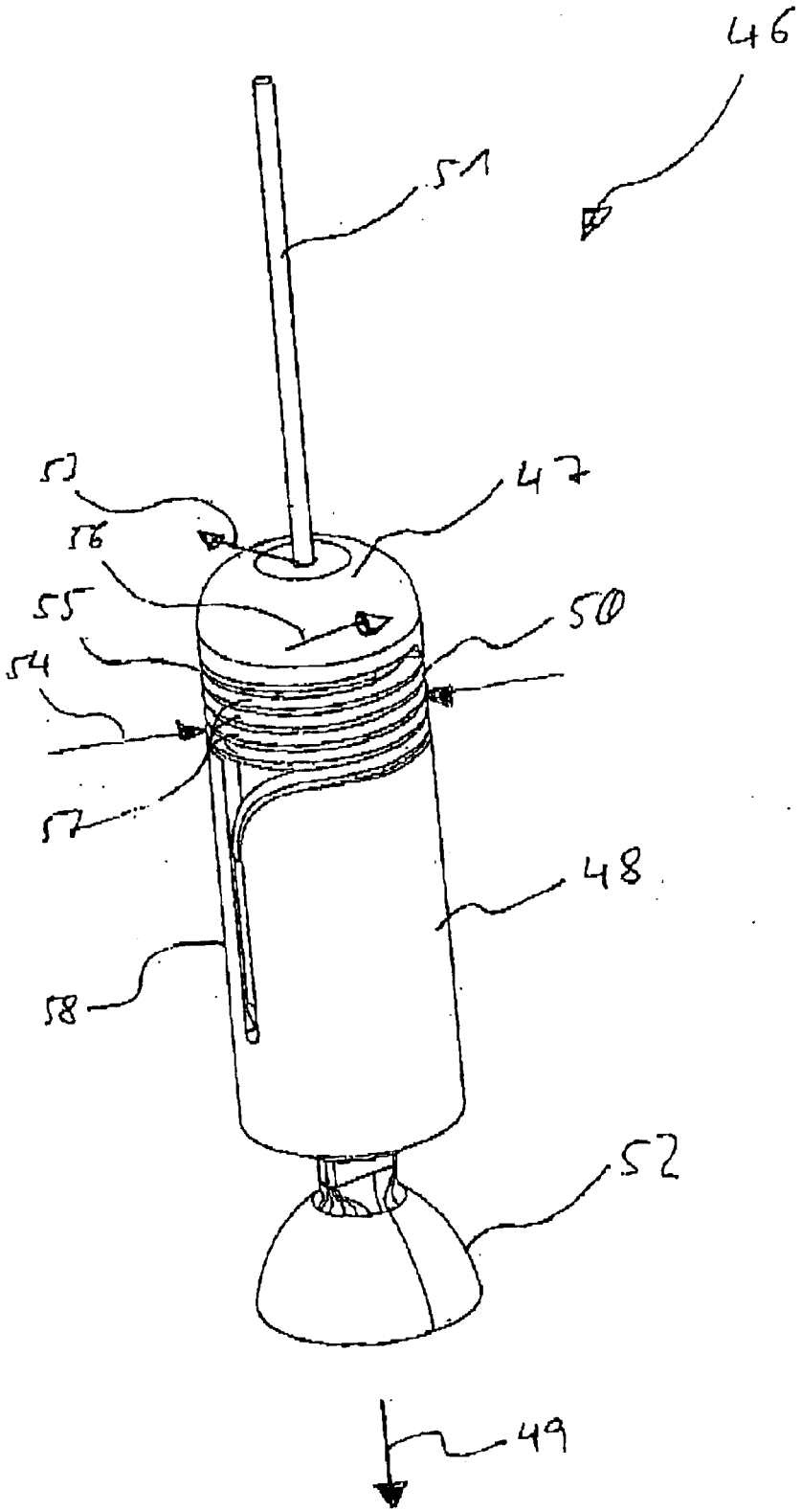
FIG. 7 represents a perspective view of a third winding apparatus.
Figure 1:
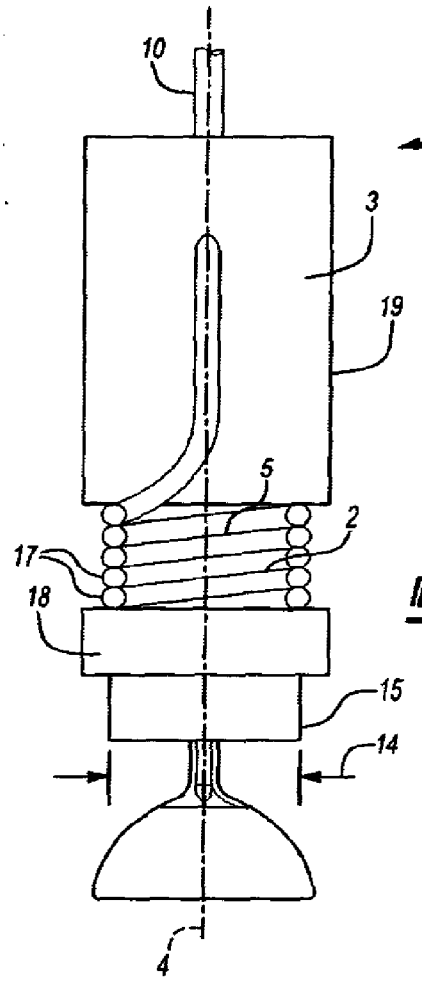
Figure 2:
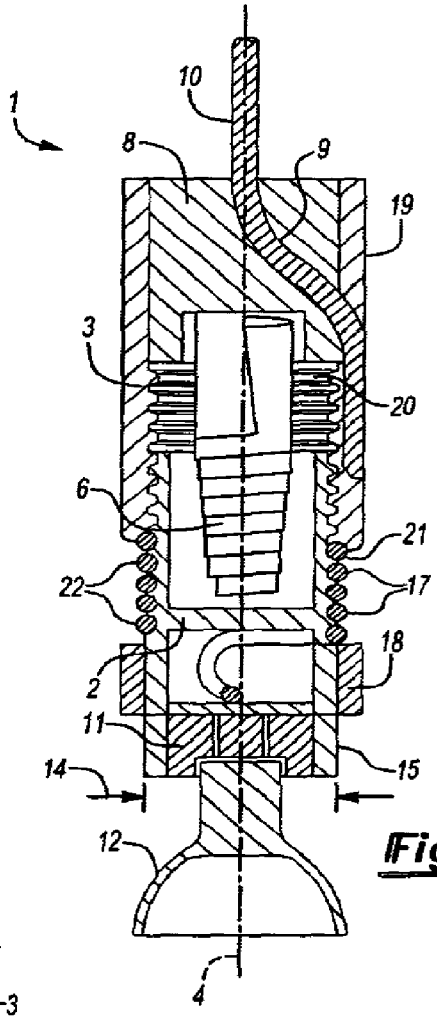
Figure 3:
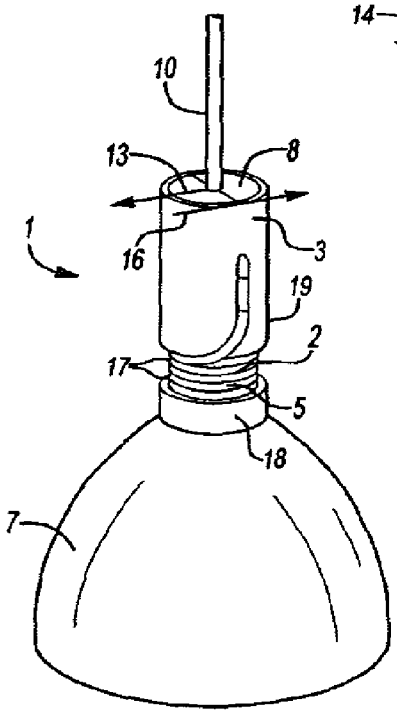
Figure 4:
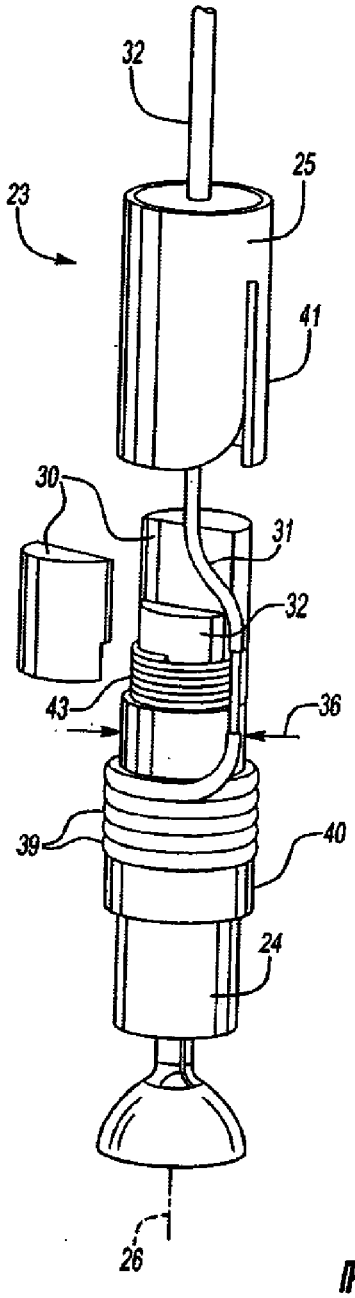
Figure 5:
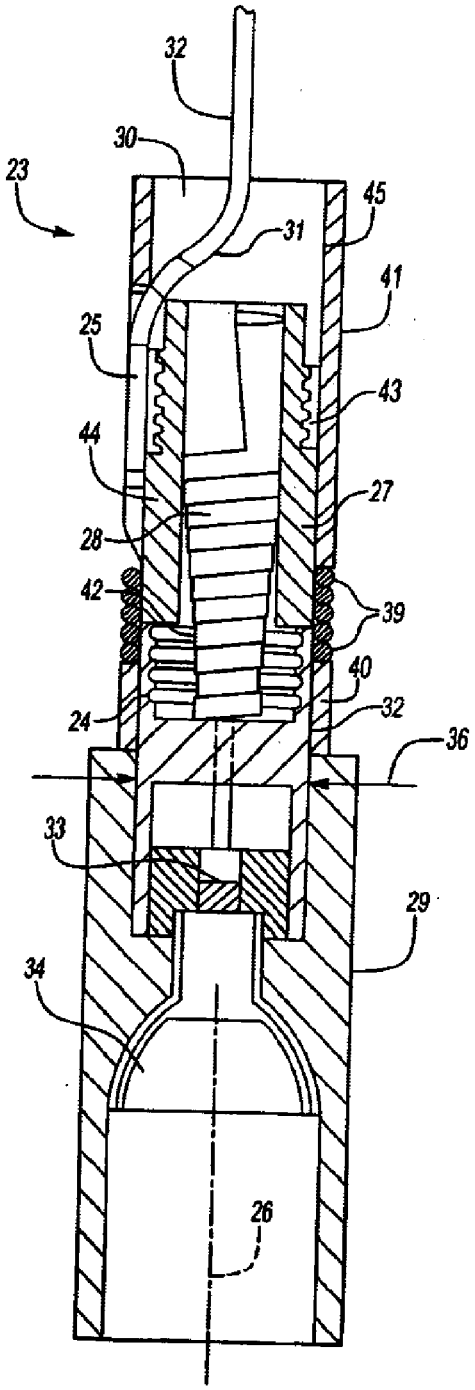
Figure 6:
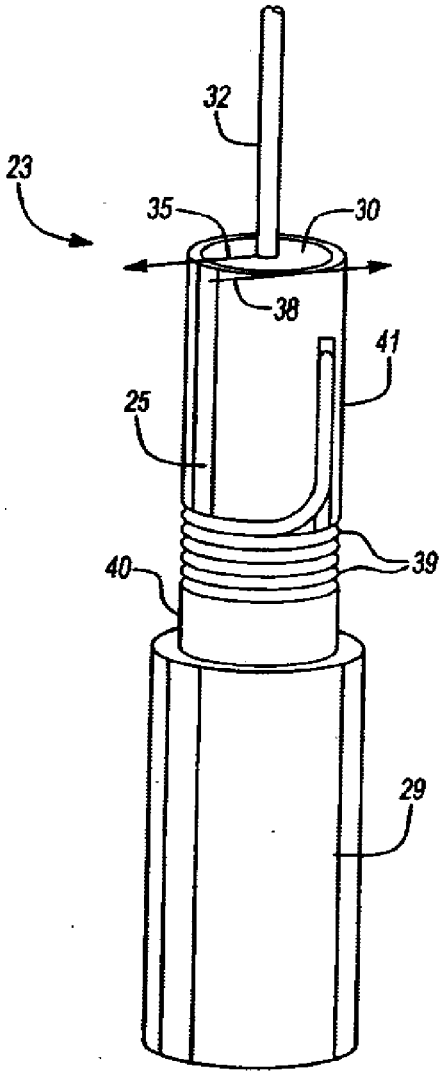
Figure 7:
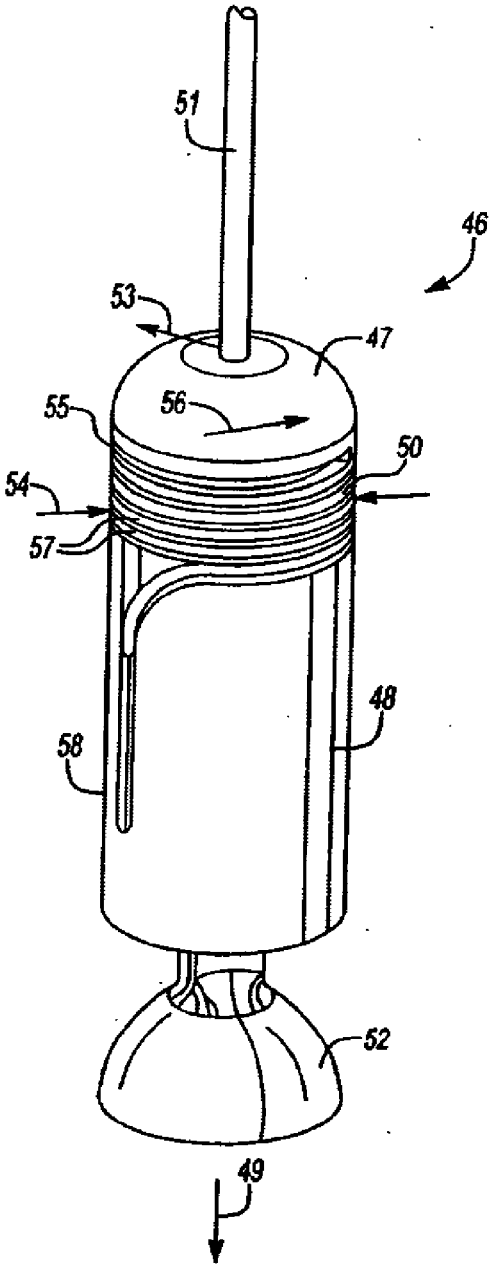

FIGS. 1 to 3, 4 to 6 and 7 represent three different embodiments—identified with the references 1, 23 and 46—of the winding apparatus according to the invention for adjusting the height of a suspended luminaire incorporating low-voltage halogen technology. The winding apparatus 1, 23, 46 comprises substantially a reel 2, 24, 47 and a guiding means 3, 25, 48 that are rotatable relative to each other and are displaceable in the direction of the reel axis 4, 26, 49, whereby these movements are made by a coupling means defined by a single-path thread 5, 27 (not shown in the winding apparatus 46) with a lead/pitch of approximately 4 mm.

The winding apparatus 1, 23 includes a driving device defined by a torsion spring 6, 28, (not shown on the winding apparatus 46) for supporting the movement, the torsion spring being connected at one end with the guiding means 3, 25, 48 and on the opposite end with the reel 2, 24, 47. The winding apparatus 1, 23 is assembled into one structural unit with a luminaire member 7, 29. At the winding apparatus 1, 23 the luminaire member 7, 29 abuts on the reel 2, 24, at the winding apparatus 46 at the guiding means 48 in a fashion not shown.

The reel 2, 24, 47 is made of aluminum rod stock and the guiding means 3, 25, 48 out of a tube of the same material. For technical manufacturing reasons a two-piece core 8, 30 made of plastic in an injection molding process and surrounds a swung conduit 9, 31.

The luminaire member 7, 29 (not shown in the winding apparatus 46) is supplied with electrical power by way of a 3 mm thick, two-stranded coaxial cable 10, 32, 51 with a braided outer strand (not shown) and without external insulation. The end (not shown) of the cable 10, 32, 51 is (likewise not shown)connected at the bottom side of the reel 2, 24 or with the top side of the reel 47. On the inside of the winding apparatus 46 a guiding connection between the reel 47 and the guiding means 48 by means of a slip ring connection (not shown). The reel 2, 24 and the guiding means 48 each comprise a stand 11, 23 (not shown on the winding apparatus 46) and with it a halogen lamp member 12, 34, 52.

At the winding apparatus 1, 23, the cable 10, 32 when being wound enters centrally from above in the axial direction 4, 26 of the reel 2, 24 into the guiding means 3, 25 and there undergoes a first diversion radially 13, 35 of the reel 2, 24 and so is led up to the outer circumference 14, 36 of the reel 2, 24. There the cable 10, 32 is again diverted axially 4, 26 to the reel 2, 24 and led over the drum surface 15, 37 of the guiding means 3, 25 vertically downwards.

At the winding apparatus 46 the cable 51, when winding, enters centrally from above axially 49 to the reel 47 into the reel 47, is led through same into the guiding means 48, undergoes there a first diversion radially 53 to the reel 47 and so led up to the outer circumference 45 of the reel 47. There the cable 51 is again diverted axially 49 to the reel 7 and led over the drum surface 55 to the guiding means 48 vertically upwards.

Still in the guiding means 3, 25, 48, the cable 10, 32, 51 is diverted tangentially 16, 38, 56 to the reel. The reel 2, 24, 47 and the guiding means 3, 25, 48 are moved away from each other by the thread 5, 27 (not shown on the winding apparatus 46) concomitantly with the rotational movement axially 4, 26, 49 of the reel 2, 24 47, the cable 10, 32, 51 exiting from the guiding means 2, 25, 48 is laid on the clearing zone of the drum surface 15, 37, 55 of the reel 2, 24, 47 in windings 17, 39, 57 disposed alongside each other.

In newly established position after winding, the torsional forces transmitted by the cable 10, 32, 51, the torque acting from the torsion spring 6, 28 (not shown in the winding apparatus 46) between guiding means 3, 25, 48 and reel 2, 24, 47 and the frictional forces of the thread 5, 27 (not shown on the winding apparatus 46) and the cable 10, 32, 51 in the guiding means 3, 25, 48 are—as they were initially—in balance. In order to change the position, the operator of the winding apparatus 1, 23, 46 grips the guiding means 3, 25 and leads it upwards or downwards, whereby the reel 2, 24 rotating about its axis 4, 26 takes up or releases a segment of cable 10, 32.

When shifting the winding apparatus 1, 23 the luminaire member 7, 29 rotates with the reel 2, 24. When shifting the winding apparatus 46 the guiding means (not shown) fastened to the guiding means 48 does not execute a rotation.

The reel 2, 24 comprises in its axial direction 4, 26 underneath the laid windings 17, 39 of the cable 10, 32 an abutting ring 18, 40 which on the one hand limits the movement of the reel 2, 24 in its axial direction 4, 26 into the guiding means 3, 25 and on the other hand optically continues the drum surface 19, 41 of the guiding means 3, 25.

The winding apparatus 1 comprises a thread 5 as an internal thread 20 in the zone of the guiding means 3 facing the reel 2 and as an external thread 21 in the zone of the guiding means 3 facing the reel 2. The troughs 22 of the external thread 21 comprise a half-round profile having a radius slightly greater than 1.5 mm so that the windings 17 of the cable 10 laid upon the reel 2 can be taken up into the troughs 22 without jamming and can be take up from them again.

The cable 10 led downwardly in the guiding means 3 axially 4 to the reel 2 lie compactly flush with the external drum surface 19 of the guiding means 3. Since the cable 10 must be led radially 13 to the reel 2 outside of the internal thread 20 of the guiding means 3, the result in this construction is necessarily that in the overall impression of the winding apparatus 1 the laid coils 17 of the cable 10 radially change direction relative to the external drum surface 19 of the guiding means 3.

In contrast, the winding apparatuses 23 and 46 act more compactly: the laid out windings 39, 57 of the cable 32, 51 lie compactly flush with the external drum surface 41, 58 of the guiding means 25, 48. The cable 32, 51 led in the guiding means 25, 48 axially 26, 49 to the reel 24, 47 also obviously lies externally compactly flush with the external drum surface 41, 58 of the guiding means 25, 48; however, it is guided directly onto the drum surface 37, 55 of the reel 24, 47.

In the winding apparatus 23 the thread 27 is configured as an internal thread 42 on the reel 24 and as an external thread 43 on an inner, tubular spike 44 connected with the guiding means 25. This spike 44 is manufactured out of thermoplastic material in an injection process integrally with the external thread 43 and connected non-rotationally (not shown in further detail) with the guiding means 25. The reel 24 is disposed between the external thread 43 of said spike 44 and the inner drum surface 45 of the guiding means 25. In the same fashion—but not shown—the rotational and translational movements of the reel 47 and the guiding means 48 are also coupled in the winding apparatus 46.

What is claimed is:

1. A winding apparatus (1, 23, 46) comprising:

a guiding means (3, 25, 48) for guiding a drawing material (10, 32, 51) onto a cylindrical drum surface (15, 37, 55) of a reel, said reel being (2, 24, 47) rotatable about an axis (4, 26, 49) relative to said guiding means (3, 25, 48), and said drawing material being taken up on said drum surface (15, 37, 55);

said apparatus characterized by said axis (4, 26, 49) of said reel (2, 24, 47) being oriented in a direction in which said drawing material (10, 32, 51) runs when entering said winding apparatus (1, 23, 46), and coupling means (5, 27) connecting said reel (2, 24, 47) to said guiding means (3, 25, 48) for displacing said reel (2, 24, 47) along said axis (4, 26, 49) relative to said guiding means (3, 25, 48).

2. A winding apparatus (1, 23, 46) as set forth in claim 1 wherein said coupling means includes two interlocking threads (5, 27).

3. A winding apparatus (1, 23, 46) as set forth in claim 2 wherein a lead/pitch of said thread (5, 27) is greater than or equal to a diameter of said drawing material (10, 32, 51).

4. A winding apparatus (1) as set forth in claim 2 wherein said thread (5) is disposed on an internal side (20) of said guiding means (3) and on a drum surface (15) of said reel (2).

5. A winding apparatus as set forth in claim 4 wherein said thread is executed with two paths and that two drawing materials are taken up on same.

6. A winding apparatus (23, 46) as set forth in claim 2 wherein said thread (27) is disposed on an external side (43) of a spike (44) on said guiding means (25, 48) and on an internal side of said reel (24, 47).

7. A winding apparatus (1, 23, 46) as set forth in claim 1 wherein said reel (2, 24, 47) and said guiding means (3, 25, 48) can be rotated relative to each other by means of a driving device.

8. A winding apparatus (1, 23, 46) as set forth in claim 7 wherein said driving device comprises a torsion spring (6, 28).

9. A winding apparatus (46) as set forth in claim 1 wherein said drawing material (51) is guided through said reel (47).

10. A suspended luminaire, in particular one using low-voltage technology, comprising:

a winding apparatus (1, 23, 46) comprising;

a guiding means (3, 25, 48) for guiding a drawing material (10, 32, 51) onto a cylindrical drum surface (15, 37, 55) of a reel, said reel being (2, 24, 47) rotatable about an axis (4, 26, 49) relative to said guiding means (3, 25, 48), and said drawing material being taken up on said drum surface (15, 37, 55); and a luminaire member (7, 29) carried by said drawing material (10, 32, 51) that can be adjusted by taking up said drawing material (10, 32, 51) onto said drum surface (15, 37, 55);

said luminaire characterized by said axis (4, 26, 49) of said reel (2, 24, 47) being oriented in a direction in which said drawing material (10, 32, 51) runs when entering said winding apparatus (1, 23, 46), and coupling means (5, 27) connecting said reel (2, 24, 47) to said guiding means (3, 25, 48) for displacing said reel (2, 24, 47) along said axis (4, 26, 49) relative to said guiding means (3, 25 48).

11. A suspended luminaire as set forth in claim 10 wherein said drawing material (10, 32, 51) is an electrical cable.

12. A suspended luminaire as set forth in claim 11 wherein said electrical cable comprises two leads.

13. A suspended luminaire as set forth in claim 12 wherein said electrical cable is configured as a coaxial cable.

14. A suspended luminaire as set forth in claim 10 wherein said luminaire member (7, 29) is connected directly with said winding apparatus (1, 23, 46).

* * * * *

UNITED STATES PATENT AND TRADEMARK OFFICE

CERTIFICATE OF CORRECTION

PATENT NO. : 6,758,581 B2
DATED : July 6, 2004
INVENTOR(S) : Konrad Weinhuber

It is certified that error appears in the above-identified patent and that said Letters Patent is hereby corrected as shown below:

Drawings,

Drawing sheets, consisting of Fig. 1 thru Fig. 7, should be deleted and replaced with the drawing sheets, consisting of Fig. 1 thru Fig. 7, as shown on the attached pages.

Signed and Sealed this

Thirtieth Day of November, 2004

JON W. DUDAS
*Director of the United States Patent and Trademark Office*

(12) United States Patent
Weinhuber

(10) Patent No.: US 6,758,581 B2
(45) Date of Patent: Jul. 6, 2004

(54) WINDING APPARATUS WITH GUIDING MEANS

(75) Inventor: Konrad Weinhuber, Oberländerstr. 27, D-81371 Munich (DE)

(73) Assignee: Konrad Weinhuber, Munich (DE)

( * ) Notice: Subject to any disclaimer, the term of this patent is extended or adjusted under 35 U.S.C. 154(b) by 0 days.

(21) Appl. No.: 10/300,159

(22) Filed: Nov. 20, 2002

(65) Prior Publication Data

US 2003/0095412 A1 May 22, 2003

(30) Foreign Application Priority Data

Nov. 20, 2001 (DE) ..... 201 18 773 U

(51) Int. Cl.[7] ..... F21V 17/08

(52) U.S. Cl. ..... 362/285; 362/258; 362/387; 362/286; 362/403; 362/288

(58) Field of Search ..... 362/285, 258, 362/387, 286, 288, 386, 403; 242/377, 378.3, 399.1, 541.6

(56) References Cited

U.S. PATENT DOCUMENTS 5,420,772 A * 5/1995 Evans ..... 362/386
2001/0040200 A1 * 11/2001 Kaipf et al. ..... 242/541.8

FOREIGN PATENT DOCUMENTS

| | | |
|---|---|---|
| DE | 175565 | * 10/1906 |
| DE | 1765470 | * 4/1958 |
| DE | 3120938 | * 2/1982 |
| DE | 4413381 | * 10/1994 |
| DE | 29518031 | * 4/1996 |

* cited by examiner

*Primary Examiner*—Alan Cariaso
*Assistant Examiner*—Mark Tsidulko
(74) *Attorney, Agent, or Firm*—Howard & Howard

(57) ABSTRACT

A winding apparatus (23) having a guiding means (25) by means of which a drawing material (32) can be led onto a cylindrical drum surface (37) of a reel (24) rotatable about its axis (26) relative to the guiding means (25) and said drawing material can be taken up onto said drum surface (37), is used for instance for adjusting the height of a suspended luminaire. In order to optically advantageously configure the connection of this winding apparatus (23) to the drawing material (32), the axis (26) of the reel (24) is oriented in the direction in which the drawing material (32) runs on entering the winding apparatus (23).

14 Claims, 3 Drawing Sheets

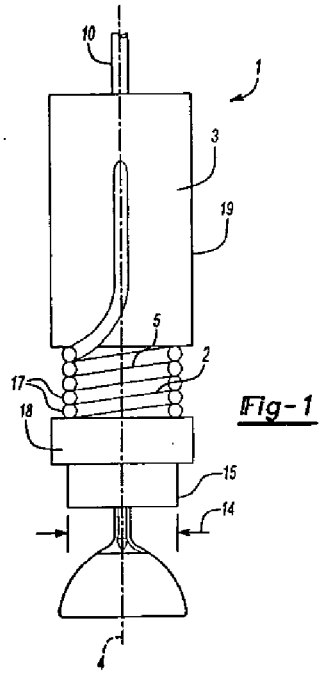

Fig-1